United States Patent [19]

Okuda

[11] Patent Number: 4,633,894

[45] Date of Patent: Jan. 6, 1987

[54] UMBRELLA RIB TIPPING SYSTEM

[75] Inventor: Toshio Okuda, Hirakata, Japan

[73] Assignee: 'totes', Incorporated, Ohio

[21] Appl. No.: 664,260

[22] Filed: Oct. 24, 1984

[30] Foreign Application Priority Data

Mar. 13, 1984 [JP] Japan ..... 59-36275[U]

[51] Int. Cl.[4] ..... A45B 15/00; A45B 25/18

[52] U.S. Cl. ..... 135/34; 135/36 RT

[58] Field of Search ..... 135/36 R, 36 RT, 36 F, 135/34, 37

[56] References Cited

U.S. PATENT DOCUMENTS

| | | | |
|---|---|---|---|
| 643,641 | 2/1900 | Fraser | 135/36 TP |
| 1,060,712 | 5/1913 | Schultz et al. | 135/36 RT |
| 1,591,880 | 7/1926 | Ornstein | 135/36 RT |
| 2,230,640 | 2/1941 | Feller | 135/34 |
| 2,504,221 | 4/1950 | Ornstein et al. | 135/36 RT |
| 2,624,357 | 1/1953 | Cutroné et al. | 135/36 RT |
| 4,089,416 | 5/1978 | Sins | 135/36 RT X |

FOREIGN PATENT DOCUMENTS

| | | | |
|---|---|---|---|
| 0036918 | 7/1980 | European Pat. Off. . | |
| 567682 | 3/1924 | France | 135/34 |
| 608764 | 10/1945 | United Kingdom . | |
| 656880 | 12/1948 | United Kingdom . | |
| 2068218 | 12/1980 | United Kingdom . | |

*Primary Examiner*—Robert A. Hafer
*Assistant Examiner*—D. N. Muir
*Attorney, Agent, or Firm*—Wood, Herron & Evans

[57] ABSTRACT

A system in which an umbrella's cover is connected to a rib tip by clamping (and not tying) the cover to the rib tip. The clamp connector is structured so that the clamping pressure between the umbrella's cover and rib tip is actually increased as the umbrella is opened in response to the cover being drawn taut over the ribs. The clamp connector, in preferred form, includes a ring receivable on a ring seat, the cover being clamped between the ring and ring seat, and the ring seat being receivable on the end of a rib tip.

2 Claims, 5 Drawing Figures

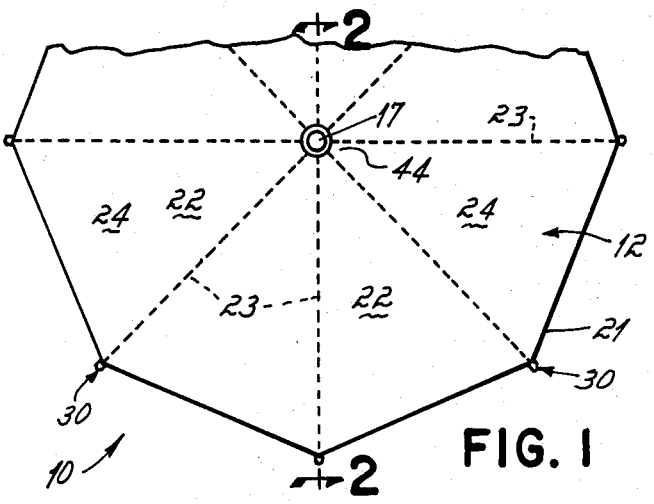
FIG. 1
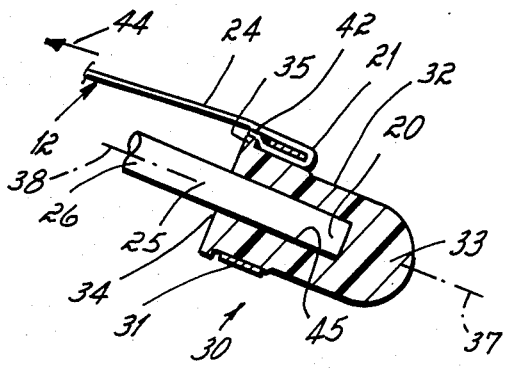
FIG. 3
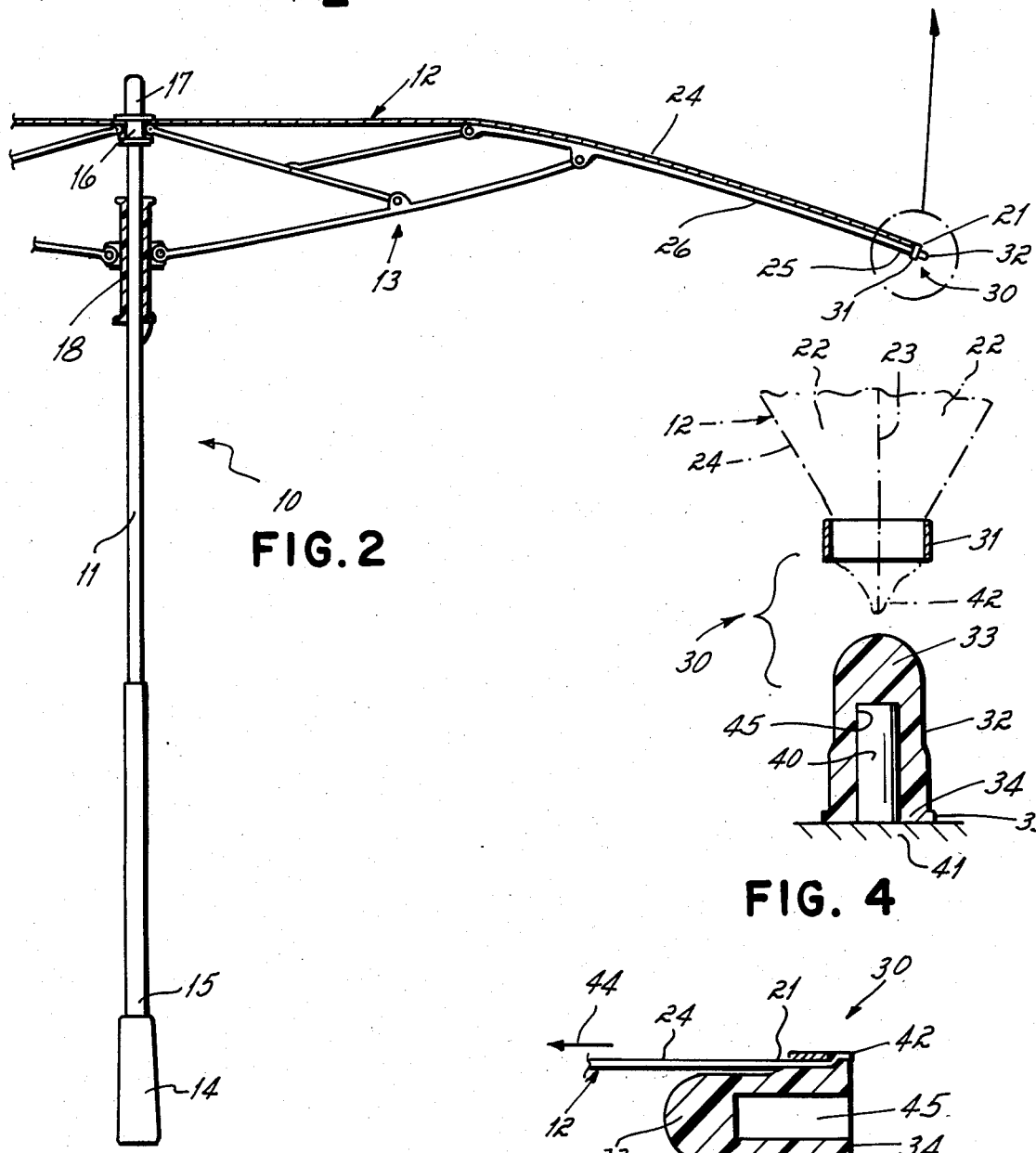
FIG. 2
FIG. 4
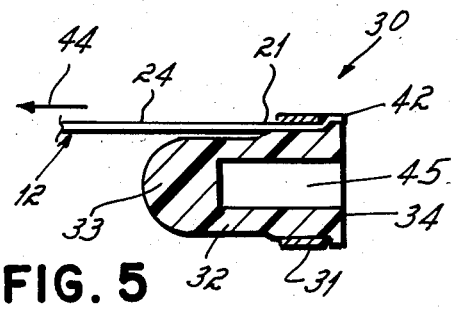
FIG. 5

UMBRELLA RIB TIPPING SYSTEM

This invention relates to umbrellas. More particularly, this invention relates to a system for connecting an umbrella's cover to the tips of an umbrella's ribs.

An umbrella basically comprises a centerpost, a rib system having six or eight ribs that extend radially from and are connected to the centerpost, and a cover. The umbrella's cover is centrally connected to the centerpost, and also is connected to each rib tip. This permits the umbrella's cover to be opened and closed easily as the ribs are erected and collapsed relative to the centerpost; and to be held taut over the rib system when the umbrella is open. Heretofore, in the prior art, the umbrella's cover has been held to the umbrella's rib tips by tying it to those rib tips. More specifically, in the prior art it is known to provide a small hole at the rib tip of each of the umbrella's six or eight ribs. That peripheral section of the umbrella's cover that overlies the rib tip is then tied to the rib tip by use of the hole in the rib tip. In this regard, the umbrella cover is commonly sewn to the rib tip by use of needle and thread with the thread passing through the rib tip's hole and being attached to the umbrella's cover section at that rib tip. This historical and widely used rib tipping system has resulted in two problems of significance that have arisen over the years. And these problems have existed for many years.

The first problem associated with the above described prior art rib tipping system is one of breakage. After an umbrella has been used by a retail consumer for a period of time, the thread by which the umbrella's cover is sewn or tied to the rib tips tends to break at one or more rib tips. This breakage often occurs due to rubbing the thread against any one of innumerable objects until it breaks, and often occurs after aging of the thread which results in its deterioration. When the tied connection at any one rib tip deteriorates to the point where the thread breaks, then the cover is no longer tied to that rib tip. And when the cover comes loose at one rib tip, the umbrella usually is considered useless thereafter by most consumers. This for the reason that the cover tends to turn up along that rib where it is no longer tied so the rain protection offered by the umbrella is decreased. However, and probably just as importantly, the aesthetic effect of an umbrella cover that is untied at one or more of its six or eight ribs is such that a lot of consumers might consider the umbrella no longer useful just for that reason.

The second problem of significance associated with the prior art system where the umbrella's cover is tied to the umbrella's ribs occurs at the manufacturing stage. The tying of an umbrella cover at six or eight locations along its periphery to each of the six or eight rib tips used in an umbrella's rib system involves hand labor. And hand labor, of course, adds significantly to the manufacturing cost of an umbrella. So it is desirable that the hand labor element in connecting an umbrella's cover to its six or eight rib tips be minimized relative to the prior art tying system.

Accordingly, it has been one objective of this invention to provide an improved umbrella rib tipping system in which an umbrella's cover is attached to at least one of the umbrella's rib tips by clamping the cover at its periphery to the umbrella's rib tip, that clamping pressure being developed without tying, i.e., without sewing, the cover to the rib tip.

It has been another objective of this invention to provide an improved umbrella rib tipping system by which an umbrella's cover can be clamped to at least one of the umbrella's rib tips, the clamping pressure being developed without tying, i.e., without sewing, the cover to the rib tip, and the clamping pressure being increased when the umbrella is opened to its use position (relative to its collapsed position) where the cover is drawn taut over its ribs, the tautness of the cover tending to enhance the clamping pressure of the cover to its rib tips when the umbrella is open.

It has been another objective of this invention to provide an improved umbrella rib tipping system by which an umbrella's cover is secured to the umbrella's rib tips through use of a clamp connector where the clamping function is established by a friction fit of the connector with the cover and the rib tip, thereby eliminating the need for tying, i.e., sewing, the cover to the rib tip, and thereby promoting the useful life of the umbrella while minimizing labor in its original manufacture.

In accord with these objectives, the preferred embodiment of this invention is directed to a system in which an umbrella's cover is connected to a rib tip by clamping (and not tying) the cover to the rib tip. The clamp connector is structured so that the clamping pressure between the umbrella's cover and rib tip is actually increased as the umbrella is opened in response to the cover being drawn taut over the ribs. The clamp connector, in preferred form, includes a ring receivable on a ring seat, the cover being clamped between the ring and ring seat, and the ring seat being receivable on the end of a rib tip.

Other objectives and advantages of this invention will be more apparent from the following detailed description taken in conjunction with the drawings in which:

FIG. 1 is a top view of an erected umbrella constructed in accordance with the rib tipping system of this invention;

FIG. 2 is a cross-sectional view taken along lines 2—2 of FIG. 1;

FIG. 3 is an enlarged cross-sectional view of the encircled portion of FIG. 2;

FIG. 4 is a view showing a first assembly method step in accord with the rib tipping system of this invention; and FIG. 5 is a cross-sectional view showing a second method assembly step in accord with the system of this invention.

An umbrella 10, as shown in FIG. 2, basically includes a centerpost 11, a cover 12, and a series of rib assemblies 13. In the embodiment shown, eight rib assemblies 13 are connected to the centerpost 11. A handle 14 is connected to the bottom end 15 of the centerpost 11, and the cover 12 is connected by a ferrule 16 to the top end 17 of the centerpost. Each rib assembly 13 is also connected to the ferrule 16 at the top end 17 of the centerpost 11, and is further connected to a slider 18 that is longitudinally movable along the centerpost. The slider 18 functions to open and close, i.e., to erect and collapse, the rib assemblies 13, so as to translate the umbrella between its erected or use position shown in FIGS. 1 and 2, and its storage position (not shown). An umbrella 10 that is useful with the rib tipping system of this invention is more particularly shown in Brooks et al Pat. No. 3,467,115, assigned to the assignee of this application, the disclosure of that patent being incorporated herein by reference.

The rib tipping system of this invention is directed to the attachment of the umbrella's cover 12 to the rib tip 20 of each of the rib assemblies 13 at the periphery 21 of the cover. Note particularly, as shown in FIG. 1, that the umbrella's cover is made up of eight gores 22, each of the gores being sewn to the other by a radial stitch line 23, thereby providing a series of eight peripheral cover sections 24 adjacent the respective ends 25 of the outer ribs 26 of the rib assemblies 13. Each of the outer ribs 26 includes a rib tip 20 which, as shown in FIG. 3, is in the form of a cylindrical rod. The peripheral section 24 of the umbrella's cover adjacent an umbrella's rib tip 20 is attached thereto by a connector 30 which functions to clamp the cover 12 to the rib 26 at its tip 20. The clamping pressure which results in the cover 12 being clamped to a rib tip 20 is a frictional pressure, and is developed by the structure of the connector 30 relative to the structure of the rib tip 20. As is readily apparent from the drawings, the cover 12 is attached to all rib tips 20 of all rib assemblies 13 without tying it to those rib tips, i.e., without any sewing of the cover to those rib tips.

The connector 30 by which the cover 12 is attached to a rib tip is shown particularly in FIGS. 3–5. The connector 30 includes a clamp in the form of a ring 31 that is received in generally co-axial telescoping fashion with the rib tip 20 so that the ring and peripheral cover section 24 are clamped by friction fit to the rib tip. In other words, the ring 31 constitutes a clamp that is cooperable with the rib tip 20, and with a peripheral section 24 of the cover, that results in the cover section being gripped or clamped between the connector 30 and the rib tip. The clamp type connector 30 also includes, in preferred form, a ring seat 32 that is in the form of a boot closed at its outer end 33 and open at its inner end 34. The boot 32 is received in generally co-axial relation on the end of the rib tip 20 and, because it is closed at its outer end 33, it is not axially slidable inward along the rib 26 toward the centerpost 11 but is held in fixed position on the rib tip. The boot 32 is configured at its inner end 34 to prevent the ring 31 from passing thereover, i.e., a shoulder 35 is formed on the boot at its inner end with the shoulder having an outside diameter larger than the inside diameter of the ring. Note particularly, as shown in FIG. 3, that the peripheral cover section 24 enters the ring between the ring's outer end 36 and the boot's outer end 33, and extends inwardly therefrom between the ring and the boot and over the boot's shoulder 35. Specifically, note that the cross-sectional configuration and cross-sectional area of the ring 31, relative to the cross-sectional area and cross-sectional configuration of the ring seat or boot 32, is such that the ring and cover section 24 are received in a friction fit type clamping relation therebetween. In other words, the inside diameter of the ring 31 relative to the outside diameter of the boot 32 is sized so that the ring can move co-axially relative to the boot's axis 37 (which is co-axial with the rib's axis 38) into a friction fit relation with the ring seat with the cover therebetween as shown in FIG. 3. While the boot 32 in this embodiment is shown as being cylindrical in outer surface geometry with a shoulder 35 at its inner end, a frustoconical geometry for the boot could also be used. In practice, and for example only, the boot 32 may be molded from nylon, and the ring 31 may be a brass ring. The underfolded, i.e., the folded back, relation of the cover section 24 relative to the ring 31 and the boot 32, as shown in FIG. 3, tends to increase the friction fit type clamping pressure between the ring and the boot as the umbrella is opened from a closed position. This increase in clamping pressure between the umbrella's cover 12 and the rib tips 20 results from or is due to the increased tautness of the cover as the cover is drawn taut over the ribs. This, of course, is advantageous in that the attachment of the cover 12 to the rib tips 20 by the clamp type connectors 30 is not weakened as the umbrella is opened, but indeed is enhanced.

The rib tipping connector 30 described above results in an easier method of attaching a rib tip 20 to the cover 12 than is the case with the historical tying or sewing method. The rib tipping system of this invention, in attaching a peripheral cover section 24 to a rib tip 20, contemplates an initial step illustrated in FIG. 4. In this initial step the boot 32 is temporarily seated on a pin 40 fixed to a base 41, the pin and base constituting an assembly form. The pin 40 is oriented vertical on the base 41 so that the boot 32 also is positioned with its outer end 33 accessible to a ring 31. A peripheral section 24 of the umbrella's cover 12, i.e., that pointed section at the sewn joint of two adjacent umbrella gores 22, is initially pushed through the ring 31 so that the cover point section extends through the ring. Thereafter the ring 31, with cover section 24 pushed therethrough, is thrust co-axially downward over the boot 32 until the ring 31 is seated against the boot's shoulder 35 with the cover point 42 extending slightly beyond the shoulder, all as shown in Figure 5. Note particularly the dimensional relationship of the ring's interior diameter vis-a-vis the seat's exterior diameter, i.e., the seated position of the ring 31 on the boot or ring seat 32 as shown in FIG. 5, results in a tight friction fit of the umbrella cover's point section 42 with the boot or ring seat 32. In this FIG. 5 intermediate position, note the closed end 33 of the boot 32 is directed radially inward toward the center 44 of the umbrella cover 12. After the FIG. 5 assembly position has been achieved, the cover 12 is simply folded over the ring 31 into that position shown in FIG. 3. With the cover so folded over the ring 31, the closed end of the boot 33 is now directed radially outward relative to the cover's center 44. When the cover 12 is provided with all connectors 30 attached thereto as shown in FIG. 5, the boots 32 are then telescoped onto the ends 25 of the ribs 26, i.e., onto the rib tips 20. The inside diameter of the bore 45 in each boot or ring seat 32 is sized, relative to the outside diameter of the rib tip 20, so as to achieve a friction fit therebetween. When all such boot or ring seats 32 are friction fit on the rib tips 20, then the umbrella's cover 12 is clamped to the rib assemblies 13.

The advantages of the umbrella rib tipping system of this invention, relative to the prior art tying or sewing system, are several. First, thread breakage where the umbrella's cover 12 is tied to the umbrella's rib tips 20 is eliminated because no thread is used in the first place. This minimizes potential disconnection of the umbrella's cover 12 at one or more rib tips 20 during use of the umbrella, thereby enhancing its useful life. Second, since tying of an umbrella's cover 12 to each of its rib tips 20 is a much more labor intensive step than utilizing the rib tipping system of this invention, the labor in the manufacture of an umbrella is reduced. This, of course, tends to promote cost efficiency in manufacture of the umbrella in the first place. And third, the umbrella rib tipping system of this invention permits the use of colors for the ring 31 and/or boot 32 by which the cover 12 is attached to the ribs 26. This use of color in the clamps that attach the cover 12 to the rib tips 20 permits coloring of the rib tips which, in turn, permits the umbrella's aesthetics to be varied by the manufacturer.

Having described in detail the preferred embodiment of my invention, what I desire to claim and protect by Letters Patent is:

1. An umbrella comprising a cover, a series of cover ribs, each rib having an inner and an outer end, and each outer end having a rib tip, a plurality of connectors with one being fixed to each rib tip, each connector comprising a ring seat having a generally tapered cross sectional configuration with a nose portion having a first diameter, seat portion having a second diameter which is greater than said first diameter, a tapered portion interim said nose portion and said seat portion and a shoulder adjacent said seat portion, and a portion of said cover being fixed to each connector by a closed cylindrical ring being received in generally co-axially sliding fashion over each ring seat portion for clamping the associated cover portion to the connector, said ring seat portion being of a cross sectional configuration and cross sectional area to receive the ring and the associated cover portion in a friction fit therewith with the cover portion being intermediate the ring and the ring seat portion, wherein the sole means of securing the cover portion to a rib is a clamping pressure exerted upon the cover portion between the ring seat and the ring and said cover being structured so that said clamping pressure is increased when said umbrella is open relative to when said umbrella is collapsed,.

2. An umbrella as set forth in claim 1, said connector comprising a boot closed at its outer end and open at its inner end, said boot being received in generally co-axial relation with said end of said rib, said boot's inner end being configured to prevent said ring from passing thereover, and said boot's outer surface defining said cross section area of said connector.

* * * * *